US010826148B2

(12) United States Patent
Takahashi

(10) Patent No.: US 10,826,148 B2
(45) Date of Patent: Nov. 3, 2020

(54) RIDGE WAVEGUIDE AND ARRAY ANTENNA APPARATUS

(71) Applicant: NEC Corporation, Tokyo (JP)

(72) Inventor: Yoshihide Takahashi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 45 days.

(21) Appl. No.: 16/088,292

(22) PCT Filed: Feb. 9, 2017

(86) PCT No.: PCT/JP2017/004795
§ 371 (c)(1),
(2) Date: Sep. 25, 2018

(87) PCT Pub. No.: WO2017/169165
PCT Pub. Date: Oct. 5, 2017

(65) Prior Publication Data

US 2019/0089035 A1 Mar. 21, 2019

(30) Foreign Application Priority Data

Mar. 31, 2016 (JP) ..... 2016-072424

(51) Int. Cl.
*H01P 3/123* (2006.01)
*H01P 5/19* (2006.01)
(Continued)

(52) U.S. Cl.
CPC ..... *H01P 3/123* (2013.01); *H01P 5/19* (2013.01); *H01P 11/002* (2013.01); *H01Q 21/005* (2013.01)

(58) Field of Classification Search
CPC ..... H01P 3/123; H01P 11/002; H01P 5/19; H01Q 21/0037; H01Q 21/0006; H01Q 21/0043; H01Q 21/005
See application file for complete search history.

(56) References Cited

U.S. PATENT DOCUMENTS 3,157,847 A 11/1964 Williams
9,343,795 B1 * 5/2016 Halligan ..... H01P 5/16
(Continued)

FOREIGN PATENT DOCUMENTS

JP 2014-170989 A 9/2014
WO 2007/114007 A1 10/2007
WO 2012/128866 A1 9/2012

OTHER PUBLICATIONS

Alireza Mallahzadeh et al., "A Low Cross-Polarization Slotted Ridged SIW Array Antenna Design With Mutual Coupling Considerations", IEEE Transactions on Antennas and Propagation, Oct. 2015, pp. 4324-4333, vol. 63, No. 10.
(Continued)

*Primary Examiner* — Robert Karacsony
(74) *Attorney, Agent, or Firm* — Sughrue Mion, PLLC

(57) ABSTRACT

A ridge waveguide (10) according to the present invention includes a ridge part (11), the ridge part (11) being in contact with both a side (14) in a long-side direction and a side (15) in a short-side direction in a cross-sectional shape of the ridge waveguide. Further, an array antenna apparatus according to the present invention includes a feeder circuit formed by a ridge waveguide (10) including a ridge part (11), the ridge part (11) being in contact with both a side (14) in a long-side direction and a side (15) in a short-side direction in a cross-sectional shape of the ridge waveguide. In this way, it is possible to provide a ridge waveguide that can be easily manufactured.

5 Claims, 12 Drawing Sheets

(51) Int. Cl.
*H01P 11/00* (2006.01)
*H01Q 21/00* (2006.01)

(56) References Cited

U.S. PATENT DOCUMENTS

| | | | | |
|---|---|---|---|---|
| 2012/0243823 | A1* | 9/2012 | Giboney | H01P 1/162<br>385/14 |
| 2013/0321229 | A1 | 12/2013 | Klefenz et al. | |
| 2018/0198215 | A1* | 7/2018 | Mandeville | H01Q 21/0087 |

OTHER PUBLICATIONS

International Search Report of PCT/JP2017/004795 dated Apr. 25, 2017 [PCT/ISA/210].

* cited by examiner

RIDGE WAVEGUIDE AND ARRAY ANTENNA APPARATUS

CROSS REFERENCE TO RELATED APPLICATIONS

This application is a National Stage of International Application No. PCT/JP2017/004795, filed Feb. 9, 2017, claiming priority based on Japanese Patent Application No. 2016-072424, filed Mar. 31, 2016, the contents of all of which are incorporated herein by reference in their entirety.

TECHNICAL FIELD

The present invention relates to a ridge waveguide and an array antenna apparatus including a feeder circuit formed by a ridge waveguide.

BACKGROUND ART

In a radio apparatus in a base station, in some cases, an array antenna composed of a printed circuited board or a waveguide structure is used in order to reduce a thickness of an antenna. For example, in a high frequency range of a millimeter wave band of 30 GHz or higher, a waveguide slot array antenna in which a waveguide having a low-loss characteristic is used as a feeder circuit structure is used in some cases. Patent Literature 1 discloses an example of such a waveguide slot array antenna.

Further, in order to enable an antenna to be used over a wide band, it is necessary to adopt a wide-band feeder circuit structure. To enable the feeder circuit to be used over a wide band, it is necessary that the amplitude and the phase of power supplied to each radiating element be independent of the frequency of the power. To meet this need, in some cases, a feeder circuit is formed by using a waveguide circuit having a tournament structure. Patent Literature 1 discloses a feeder circuit in which branches are formed in a stepwise manner in a tournament pattern by using a plurality of layered metal plates.

However, for example, there are cases in which a size in an H-plane direction of a waveguide is restricted, such as a case in which a feeder circuit having a tournament structure is formed by using one metal plate. FIG. 11 shows an example of a feeder circuit having a tournament structure in related art. In FIG. 11, an XY-plane corresponds to an H-plane. In a metal plate 100 shown in FIG. 11, a length in an X-direction on the H-plane is restricted. Specifically, a width (a length in the X-direction) of a waveguide circuit 101 is about 80% of a size of a standard waveguide. Further, a length in the X-direction of a part between a feeding point 102 and a part of the waveguide circuit 101 adjacent to the feeding point 102, i.e., a part indicated by a reference numeral 103 is 1 mm or shorter, i.e., is extremely short. When the size in the H-plane direction of the waveguide is restricted as described above, a low frequency range in a specified band gets closer to a cutoff frequency of the waveguide. As a result, a pass loss of the feeder circuit increases and hence an antenna gain decreases.

Patent Literature 2 discloses that a ridge waveguide is used as a waveguide structure. Compared to a rectangular waveguide, the ridge waveguide can lower a cutoff frequency. That is, by using a ridge waveguide as a waveguide structure as shown in Patent Literature 2, it is possible to lower the cutoff frequency as compared to that in the rectangular waveguide.

CITATION LIST

Patent Literature

Patent Literature 1: Japanese Unexamined Patent Application Publication No. 2014-170989
Patent Literature 2: United State Patent Application Publication No. 2013/0321229

SUMMARY OF INVENTION

Technical Problem

Meanwhile, it has been desired to manufacture a waveguide by using a method in which a thin-plate metal, a metal-plated printed circuit board, a metal-plated plastic, or a conductive resin material is laminated by using diffusion bonding, welding, a 3D printer, or the like (hereinafter also referred to as a "thin-plate laminating method"). However, in a ridge waveguide having a shape disclosed in Patent Literature 2 (hereinafter also referred to as "normal ridge waveguide"), there has been a problem that such a ridge waveguide cannot be manufactured by using the thin-plate laminating method.

Here, why a normal ridge waveguide having a shape disclosed in Patent Literature 2 cannot be manufactured by using the thin-plate laminating method is explained with reference to FIGS. 12 to 14.

The inventor of the present application has studied how to manufacture a ridge waveguide by using the thin-plate laminating method. FIG. 12 shows a T-branch circuit of a normal ridge waveguide 110. Further, FIG. 13 shows a cross-sectional shape of the normal ridge waveguide 110 taken along a line in FIG. 12. In the normal ridge waveguide 110, a ridge part 111 is an independent projection part.

FIG. 14 is an image diagram showing the XIII-XIII cross-sectional shape of the normal ridge waveguide 110 when it is manufactured by using the thin-plate laminating method. When the normal ridge waveguide 110 is manufactured by using the thin-plate laminating method, the ridge part 111 becomes an independent part separated from thin plates 112 to 114 and thin plates 115 to 117 as shown in FIG. 14. Therefore, the ridge part 111 cannot be positioned and cannot be formed by laminating thin plates. Accordingly, the inventor of the present application has found a problem that the normal ridge waveguide 110 having the shape described in Patent Literature 2 cannot be manufactured by using the thin-plate laminating method.

Further, as shown in FIG. 13, in the normal ridge waveguide 110, the length in the X-direction of adjacent parts 118 and 119 of the ridge part 111 in the XIII-XIII cross-sectional shape is short. For example, when the length of the longest part in the X-direction in the cross-sectional shape of the normal ridge waveguide 110 is adjusted to about 80% of the size of the standard waveguide, the length in the X-direction of the adjacent parts 118 and 119 of the ridge part 111 is 1 mm or shorter, i.e., is extremely short. As a result, there has been a problem that when a cutting process is performed, it is very difficult to perform the cutting process by using a drill.

The present invention has been made to solve the above-described problem and an object thereof is to provide a ridge waveguide that can be easily manufactured.

Solution to Problem

A ridge waveguide according to the present invention includes a ridge part, the ridge part being in contact with both a side in a long-side direction and a side in a short-side direction in a cross-sectional shape of the ridge waveguide.

Advantageous Effects of Invention

According to the present invention, it is possible to provide a ridge waveguide that can be easily manufactured.

DESCRIPTION OF EMBODIMENTS

First Embodiment

Figure 1:
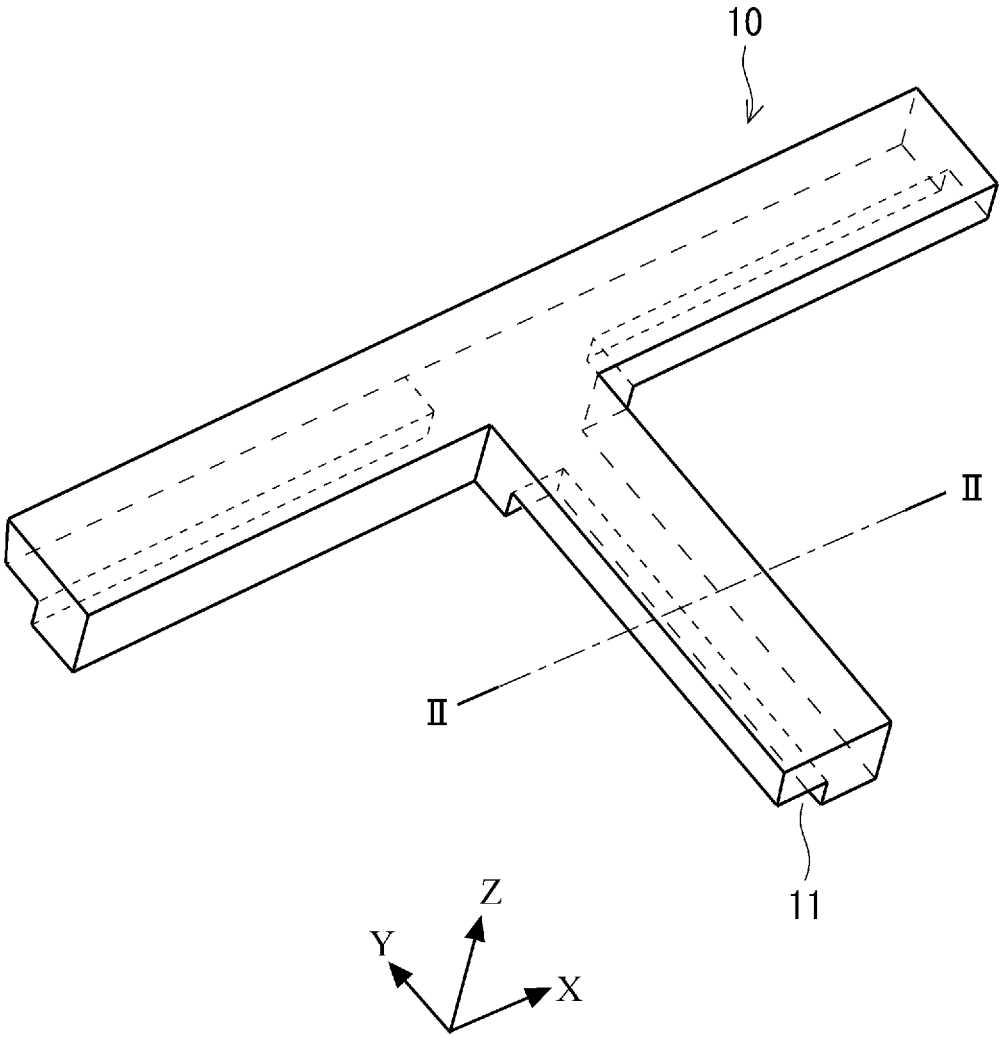
FIG. 1 shows a T-branch circuit of a ridge waveguide according to a first embodiment of the present invention.

Embodiments according to the present invention will be described hereinafter with reference to the drawings. FIG. 1 shows a T-branch circuit of a ridge waveguide 10 according to a first embodiment of the present invention. The ridge waveguide 10 is a ridge waveguide constituting a feeder circuit of an array antenna. Further, the ridge waveguide 10 includes a ridge part 11.

Figure 2:
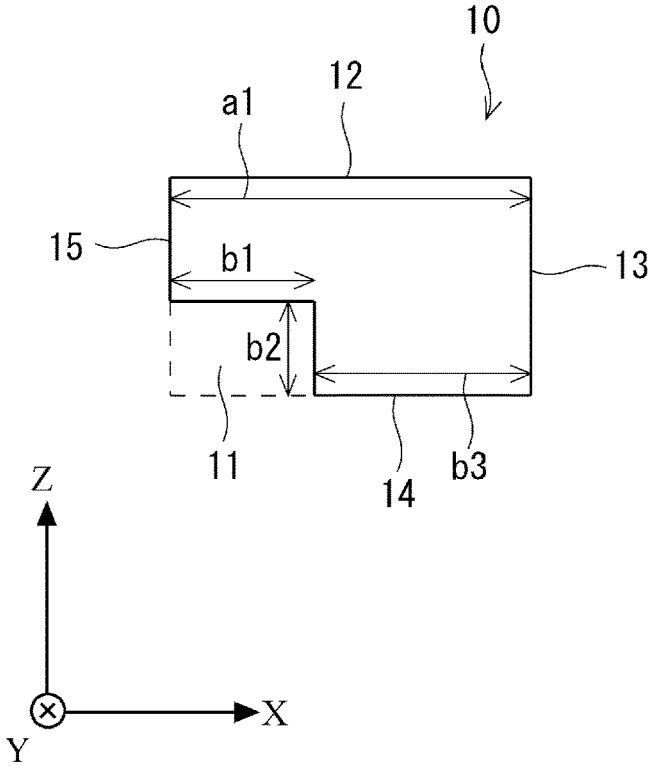
FIG. 2 shows a cross-sectional shape of the ridge waveguide shown in FIG. 1.

FIG. 2 shows a cross-sectional ape of the ridge waveguide 10 taken along a line 11-11 in FIG. 1. The II-II cross-sectional shape of the ridge waveguide 10 is composed of sides 12 and 14 in a long-side direction (an X-direction), sides 13 and 15 in a short-side direction (a Z-direction), and the ridge part 11. Further, the ridge part 11 is in contact with both the side 14 in the long-side direction and the side 15 in the short-side direction.

A cutoff frequency of the ridge waveguide 10 is determined according to a length a1 in the X-direction of the side 12 in the long-side direction, a length b1 in the X-direction of the ridge part 11, a length b2 in the Z-direction of the ridge part 11, and a length b3 in the X-direction of the side 14 in the long-side direction. Specifically, the lower the length a1 is, the more the cutoff frequency of the ridge waveguide 10 can be made. Further, the longer a value obtained by adding b1, b2 and b3 is, the lower the cutoff frequency of the ridge waveguide 10 can be made. Note that the length b1 in the X-direction and the length b2 in the Z-direction of the ridge part 11 may be adjusted according to the value of the specified band.

Figure 13:
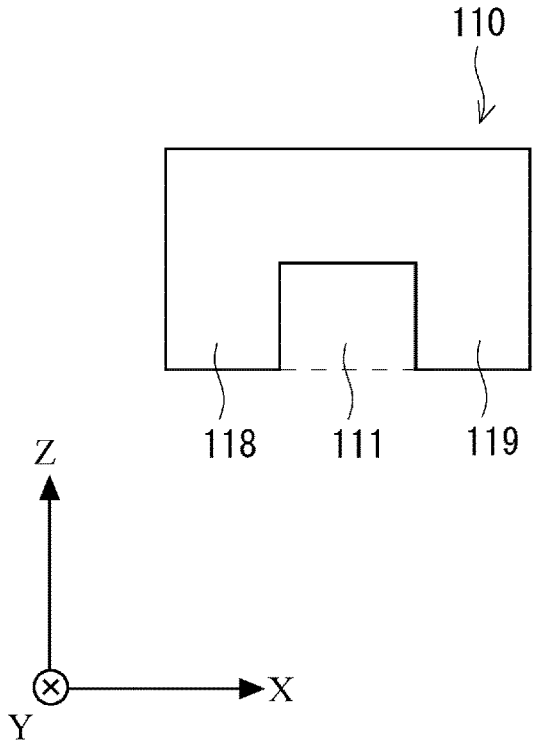
FIG. 13 shows a cross-sectional shape of the normal ridge waveguide shown in FIG. 12.
Figure 14:
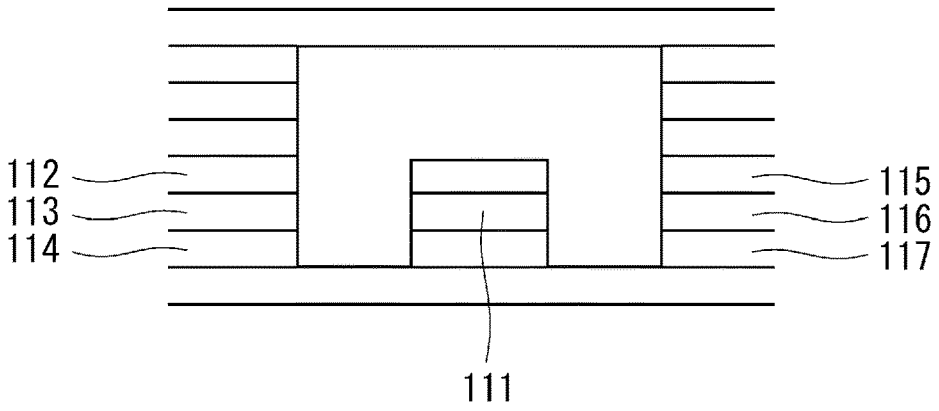
FIG. 14 is an image diagram showing a cross-sectional shape of the normal ridge waveguide shown in FIG. 12 when the normal ridge waveguide is manufactured by using a thin-plate laminating method.

The side 14 in the long-side direction of the ridge waveguide 10 in the II-II cross-sectional shape differs from the two divided adjacent parts 118 and 119 of the ridge part 111 shown in FIG. 13. Therefore, it is possible to make the length in the X-direction of the side 14 in the long-side direction longer than the length in the X-direction of each of the adjacent parts 118 and 119 of the ridge part 111.

Figure 3:
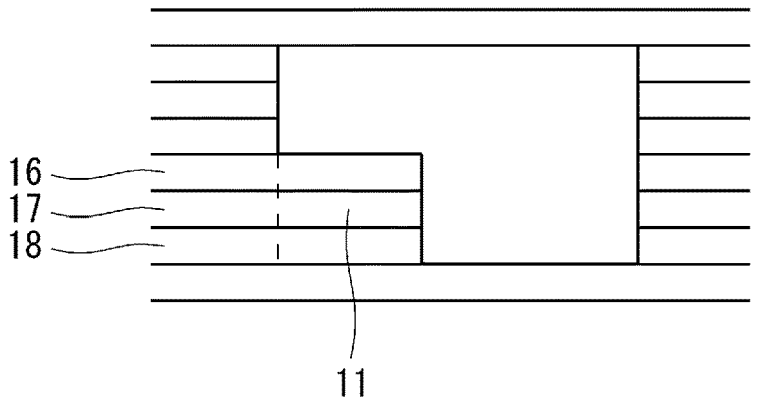
FIG. 3 is an image diagram showing a cross-sectional shape of the ridge waveguide shown in FIG. 1 when the ridge waveguide is manufactured by using a thin-plate laminating method.

FIG. 3 is an image diagram showing the II-II cross-sectional shape of the ridge waveguide 10 when it is manufactured by using a thin-plate laminating method. In FIG. 3, the ridge part 11 is formed by a part of each of thin plates 16 to 18. That is, the ridge part 11 is not separated from the thin plates 16 to 18. Therefore, the ridge waveguide 10 can be formed as a waveguide having a structure in which thin-plate metals are laminated, or a structure in which metal-plated printed circuit boards are laminated. That is, the ridge waveguide 10 can be manufactured by using the thin-plate laminating method.

Note that the example shown FIGS. 1 to 3 is explained on the assumption that the ridge part 11 is positioned in a lower-left part in the II-II cross-sectional shape of the ridge waveguide 10, i.e., in a place where the ridge part 11 is in contact with both the side 14 in the long-side direction and the side 15 in the short-side direction. However, the position of the ridge part 11 is not limited to the above-described position. The ridge part 11 may be positioned in a place where the ridge part 11 is in contact with both the side 12 in the long-side direction and the side 13 in the short-side direction, a place where the ridge part 11 is in contact with both the side 14 in the long-side direction and the side 13 in the short-side direction, or a place where the ridge part 11 is in contact with both the side 12 in the long-side direction and the side 15 in the short-side direction.

Further, the example shown in FIGS. 1 to 3 is explained on the assumption that the ridge waveguide 10 includes one ridge part. However, the ridge waveguide 10 may include a plurality of ridge parts. In such a case, each of the plurality of ridge parts may be positioned in a place where the ridge part is in contact with both a side in the long-side direction and a side in the short-side direction.

As described above, the ridge waveguide 10 according to the first embodiment of the present invention includes a ridge part that is in contact with both a side in the long-side direction and a side in the short-side direction in the cross-sectional shape in the ridge waveguide. As a result, the ridge waveguide 10 can be manufactured by using the thin-plate laminating method.

Further, in the ridge waveguide 10 according to the first embodiment of the present invention, it is possible to make the length in the X-direction of the side in the long-side direction that is in contact with the ridge part longer than the length in the X-direction of each of the adjacent parts 118 and 119 of the ridge part 111 shown in FIG. 13. As a result, in the ridge waveguide 10, it is possible to, when a cutting process is performed, easily perform the cutting process by using a drill as compared to the cutting process in the normal ridge waveguide 110.

Therefore, by adopting the structure of the ridge waveguide 10 according to the first embodiment of the present invention, it is possible to provide a ridge waveguide that can be easily manufactured.

Second Embodiment

Next, a second embodiment according to the present invention will be described. In the second embodiment, an example of a ridge waveguide having a plurality of ridge parts is described. Note that in the second embodiment, descriptions of components and structures similar to those in the first embodiment are omitted as appropriate.

Figure 4:
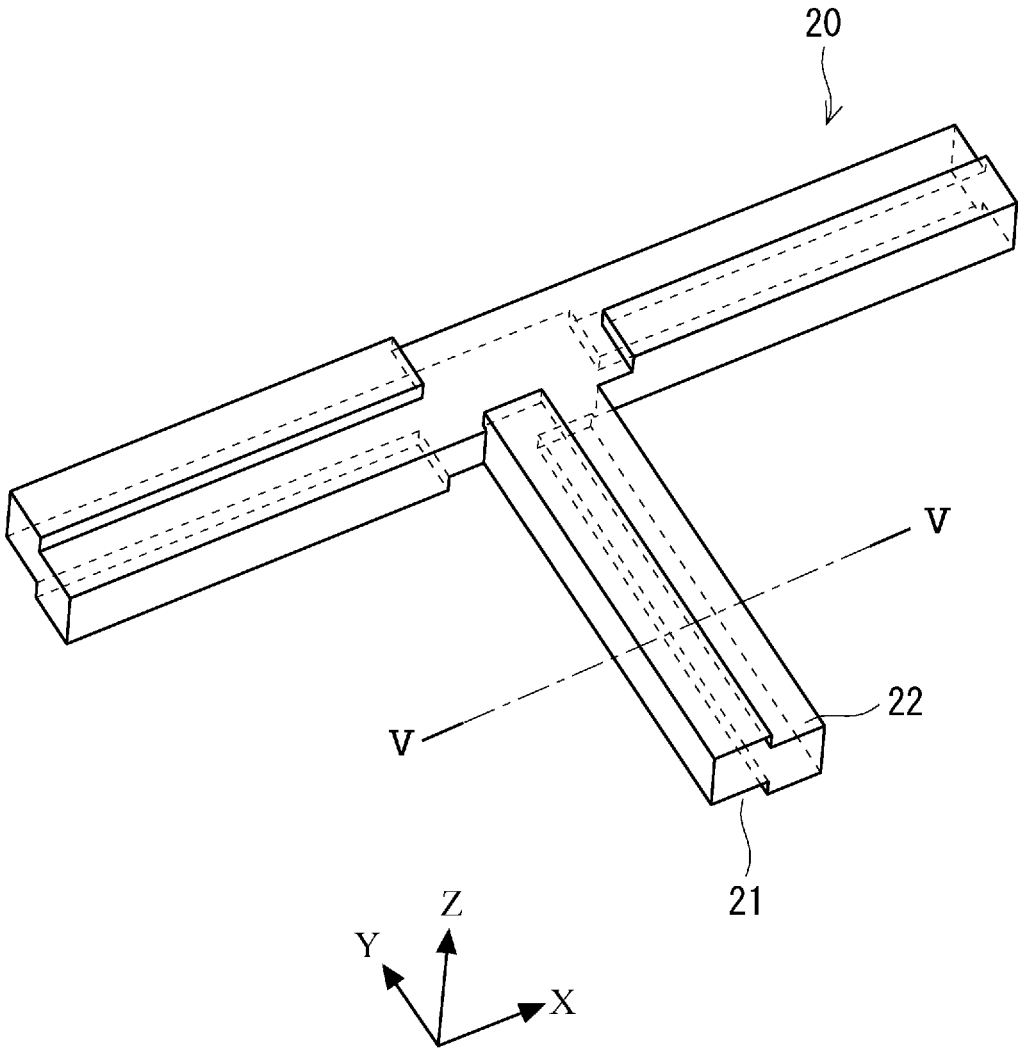
FIG. 4 shows a T-branch circuit of an S-shaped ridge waveguide according to a second embodiment of the present invention.

FIG. 4 shows a T-branch circuit of an S-shaped ridge waveguide 20 according to a second embodiment of the present invention. The S-shaped ridge waveguide 20 includes a ridge part 21 and a ridge part 22. Note that in the S-shaped ridge waveguide 20, the ridge parts 21 and 22 are arranged so that a cross-sectional shape of the S-shaped ridge waveguide 20 taken along a line V-V becomes an S-shape.

Figure 5:
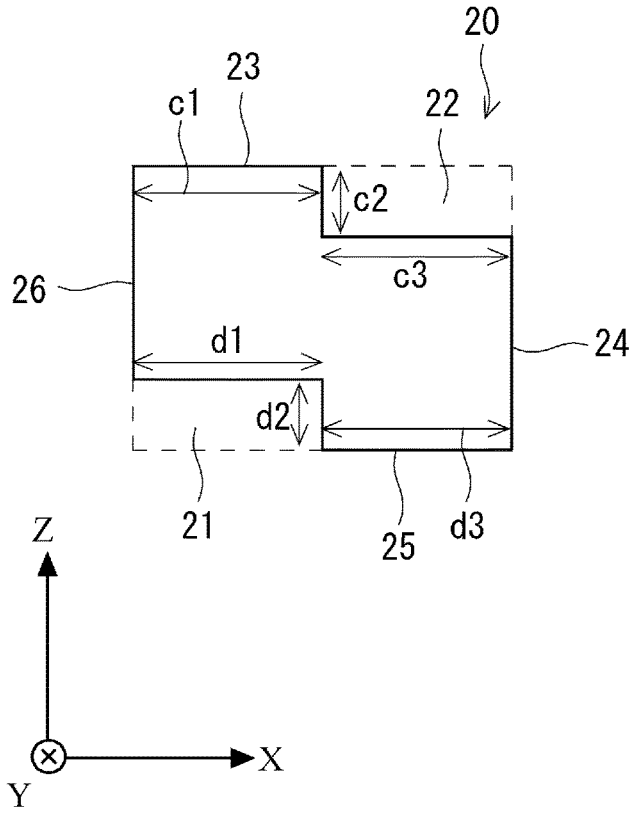
FIG. 5 shows a cross-sectional shape of the S-shaped ridge waveguide shown in FIG. 4.

FIG. 5 shows the V-V cross-sectional shape of the S-shaped ridge waveguide 20 shown in FIG. 4. The V-V cross-sectional shape of the S-shaped ridge waveguide 20 is composed of sides 23 and 25 in a long-side direction (an X-direction), sides 24 and 26 in a short-side direction (a Z-direction), and the ridge parts 21 and 22. Further, the ridge part 21 is in contact with both the side 25 in the long-side direction and the side 26 in the short-side direction. Further, the ridge part 22 is in contact with both the side 23 in the long-side direction and the side 24 in the short-side direction.

A cutoff frequency of the S-shaped ridge waveguide 20 is determined according to a length c1 in the X-direction of the side 23 in the long-side direction, a length c2 in the Z-direction of the ridge part 22, a length c3 in the X-direction of the ridge part 22, a length d1 in the X-direction of the ridge part 21, a length d2 in the Z-direction of the ridge part 21, and a length d3 in the X-direction of the side 25 in the long-side direction. Specifically, the longer a value obtained by adding c1, c2 and c3 is, the lower the cutoff frequency of the S-shaped ridge waveguide 20 can be made. Further, the longer a value obtained by adding d1, d2 and d3 is, the lower the cutoff frequency of the S-shaped ridge waveguide 20 can be made. That is, in the S-shaped ridge waveguide 20, the cutoff frequency of the S-shaped ridge waveguide 20 can be adjusted by the lengths in the X- and Z-directions of the ridge part 21 and the lengths in the X- and Z-directions of the ridge part 22.

Figure 6:
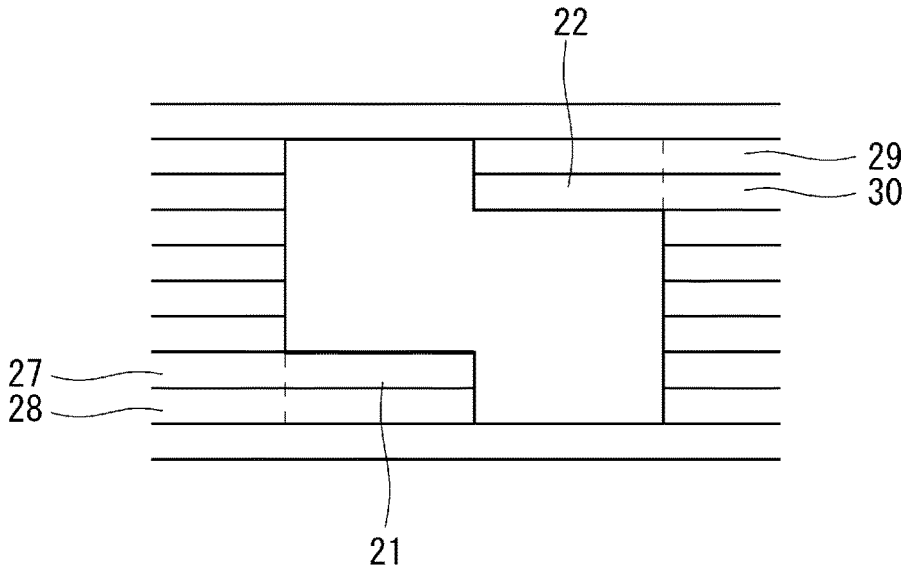
FIG. 6 is an image diagram showing a cross-sectional shape of the S-shaped ridge waveguide shown in FIG. 4 when the S-shaped ridge waveguide is manufactured by using a thin-plate laminating method.

FIG. 6 is an image diagram showing the V-V cross-sectional shape of the S-shaped ridge waveguide 20 when it is manufactured by using a thin-plate laminating method. In FIG. 6, the ridge part 21 is formed by a part of each of thin plates 27 and 28. That is, the ridge part 21 is not separated from the thin plates 27 and 28. Further, the ridge part 22 is formed by a part of each of thin plates 29 and 30. That is, the ridge part 22 is not separated from the thin plates 29 and 30. Therefore, the S-shaped ridge waveguide 20 can be formed as a waveguide having a structure in which thin-plate metals are laminated, or a structure in which metal-plated printed circuit boards are laminated. That is, the S-shaped ridge waveguide 20 can be manufactured by using the thin-plate laminating method.

Figure 7:
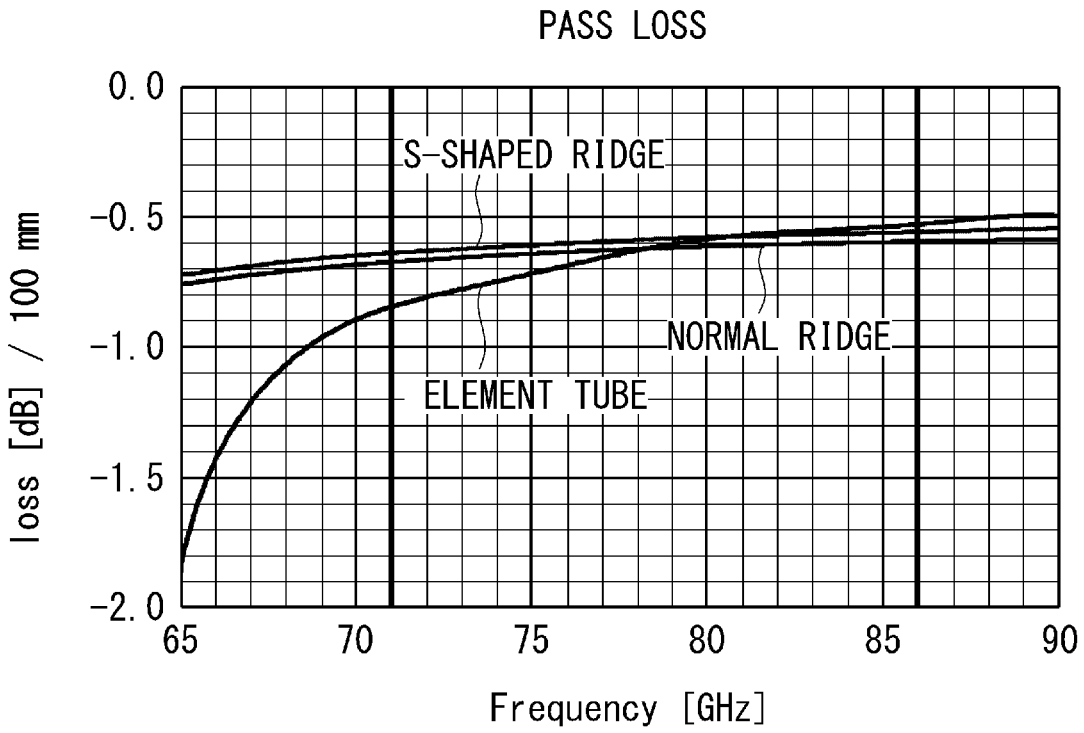
FIG. 7 is a graph showing differences in losses due to cross-sectional shapes of waveguides.
Figure 8A:
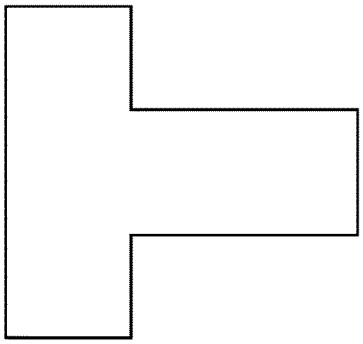
FIG. 8A shows another example of a cross-sectional shape of a ridge waveguide according to the second embodiment of the present invention.
Figure 8B:
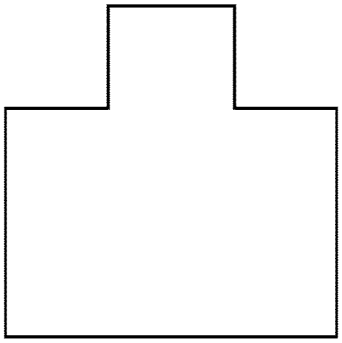
FIG. 8B shows another example of a cross-sectional shape of a ridge waveguide according to the second embodiment of the present invention.
Figure 8C:
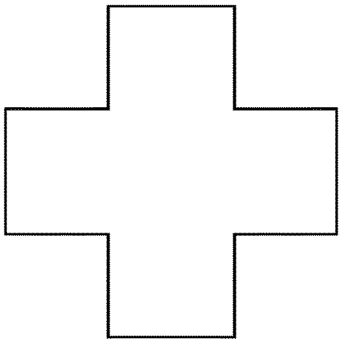
FIG. 8C shows another example of a cross-sectional shape of a ridge waveguide according to the second embodiment of the present invention.
Figure 8D:
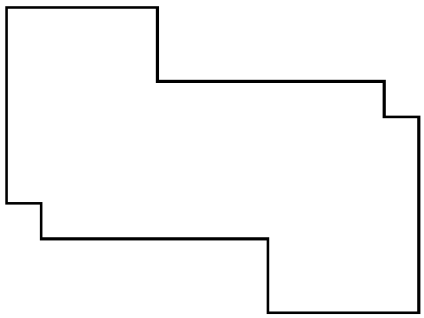
FIG. 8D shows another example of a cross-sectional shape of a ridge waveguide according to the second embodiment of the present invention.
Figure 8E:
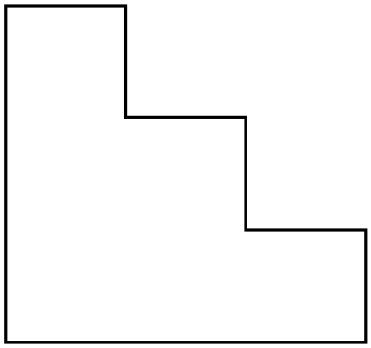
FIG. 8E is a view showing another example of the cross-sectional shape of the ridge waveguide according to the second embodiment of the present invention.

Next, differences in losses due to cross-sectional shapes of waveguides are explained with reference to FIG. 7. Note that in FIG. 7, an element tube means a rectangular waveguide that differs from a ridge waveguide. FIG. 7 shows frequency characteristics of pass losses in an element tube, a normal ridge waveguide, and an S-shaped ridge waveguide, in each of which the length of the longest part in the long-side direction in its cross-sectional shape is adjusted to about 80% of the size of the standard waveguide. Similarly to the normal ridge waveguide, it is possible to lower the cutoff frequency of the S-shaped ridge waveguide as compared to the cutoff frequency of the element tube.

As described above, in the S-shaped ridge waveguide 20 according to the second embodiment of the present invention, the ridge parts 21 and 22 are arranged so that the V-V cross-sectional shape of the S-shaped ridge waveguide 20 becomes an S shape. In this way, it is possible to adjust the cutoff frequency of the S-shaped ridge waveguide 20 by the lengths in the X- and Z-directions of the ridge part 21 and the lengths in the X- and Z-directions of the ridge part 22. That is, compared to the case where there is only one ridge part, it is possible to improve flexibility in the adjustment of the cutoff frequency of the ridge waveguide.

Note that in the second embodiment, the S-shaped ridge waveguide 20 is described as an example of a ridge waveguide including a plurality of ridges. However, the ridge waveguide including a plurality of ridges is not limited to those having the above-described cross-sectional shape. For example, ridge waveguides having cross-sectional shapes shown in FIGS. 8A to 8E may be used.

Third Embodiment

Next, a third embodiment according to the present invention will be described. The third embodiment is a modified example of the second embodiment. In the third embodiment, descriptions of components and structures similar to those in the second embodiment are omitted as appropriate.

Figure 9:
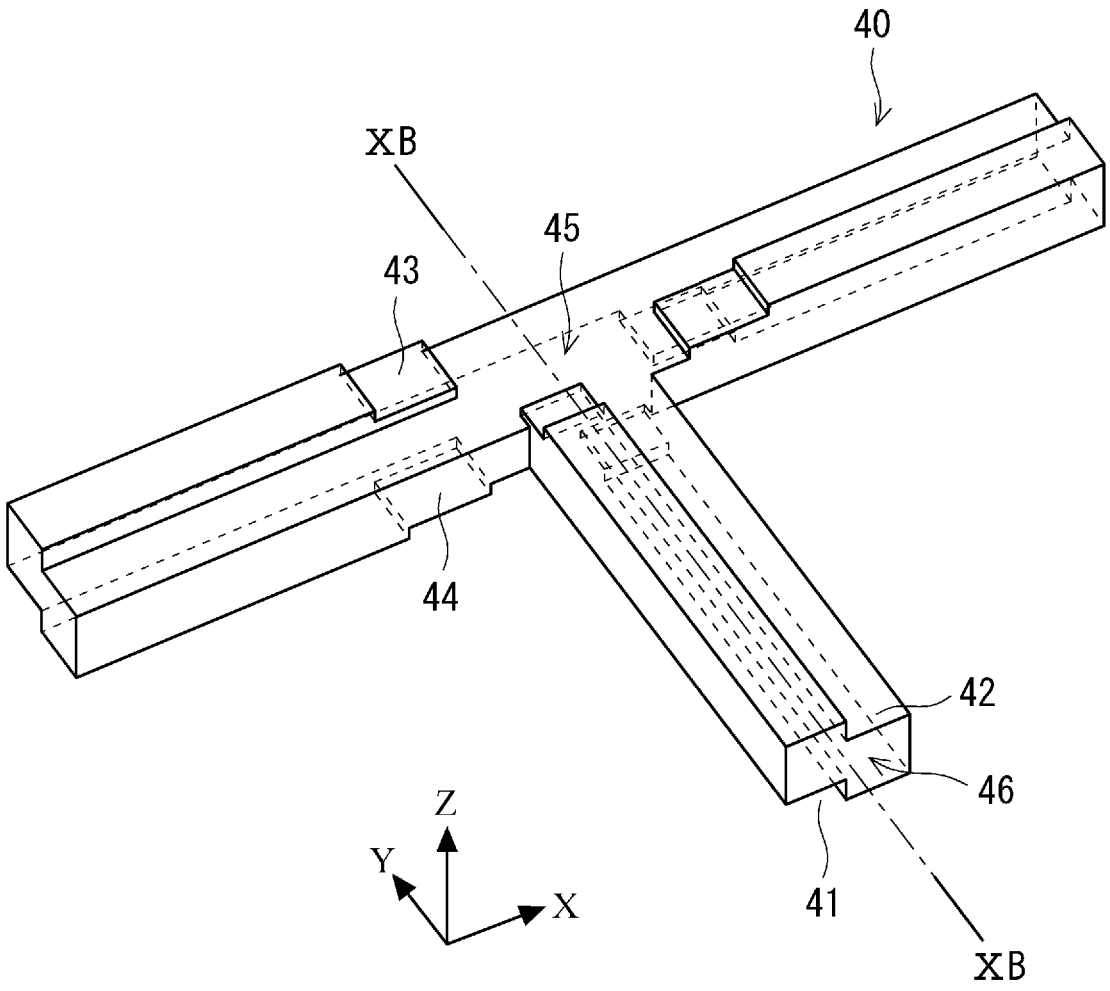
FIG. 9 shows a T-branch circuit of an S-shaped ridge waveguide according to a third embodiment of the present invention.

FIG. 9 shows a T-branch circuit of an S-shaped ridge waveguide 40 according to the third embodiment of the present invention. The S-shaped ridge waveguide 40 includes ridge parts 41 and 42, and step structures 43 and 44. Note that the ridge parts 41 and 42 are similar to the ridge parts 21 and 22 of the second embodiment, and therefore descriptions thereof are omitted.

Next, the step structures 43 and 44 of the S-shaped ridge waveguide 40 are described with reference to FIG. 10. FIG. 10B shows a cross-sectional shape of the S-shaped ridge waveguide 40 taken along a line XB-XB in FIG. 9. Further, FIG. 10A shows a cross-sectional shape of an S-shaped ridge waveguide that does not include the step structures 43 and 44 for a comparison to the cross-sectional shape shown in FIG. 10B.

Figure 10A:
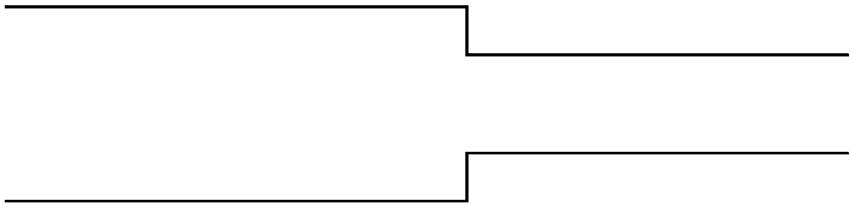
FIG. 10A is a diagram for explaining a step structure of the S-shaped ridge waveguide shown in FIG. 9.
Figure 10B:
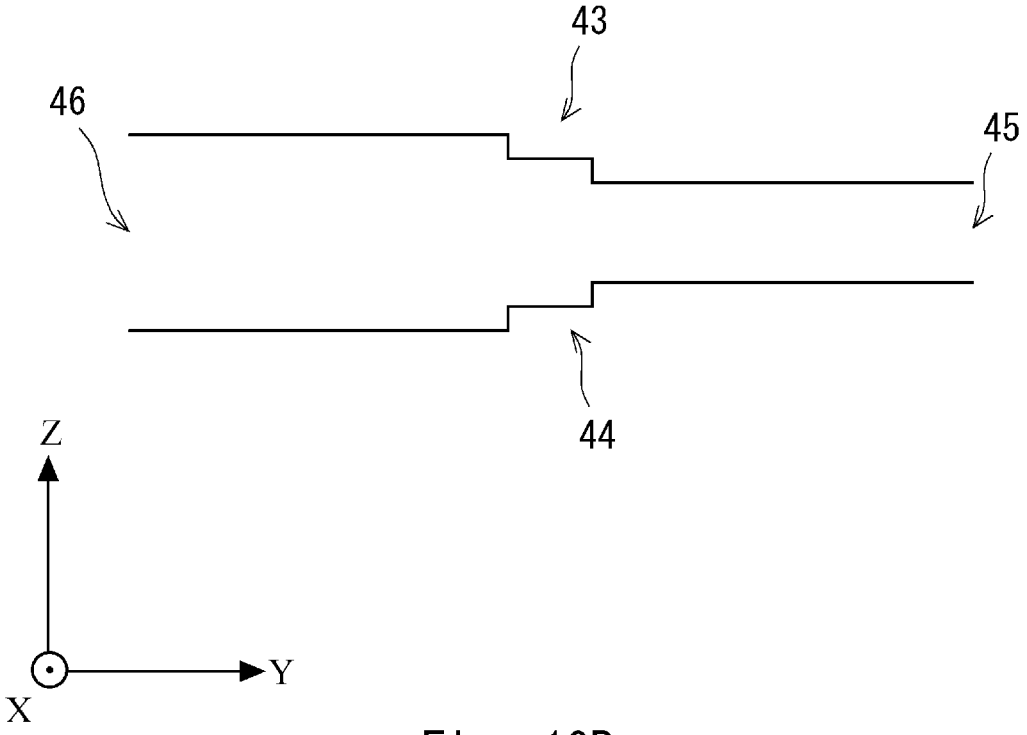
FIG. 10B is a diagram for explaining a step structure of the S-shaped ridge waveguide shown in FIG. 9.
Figure 11:
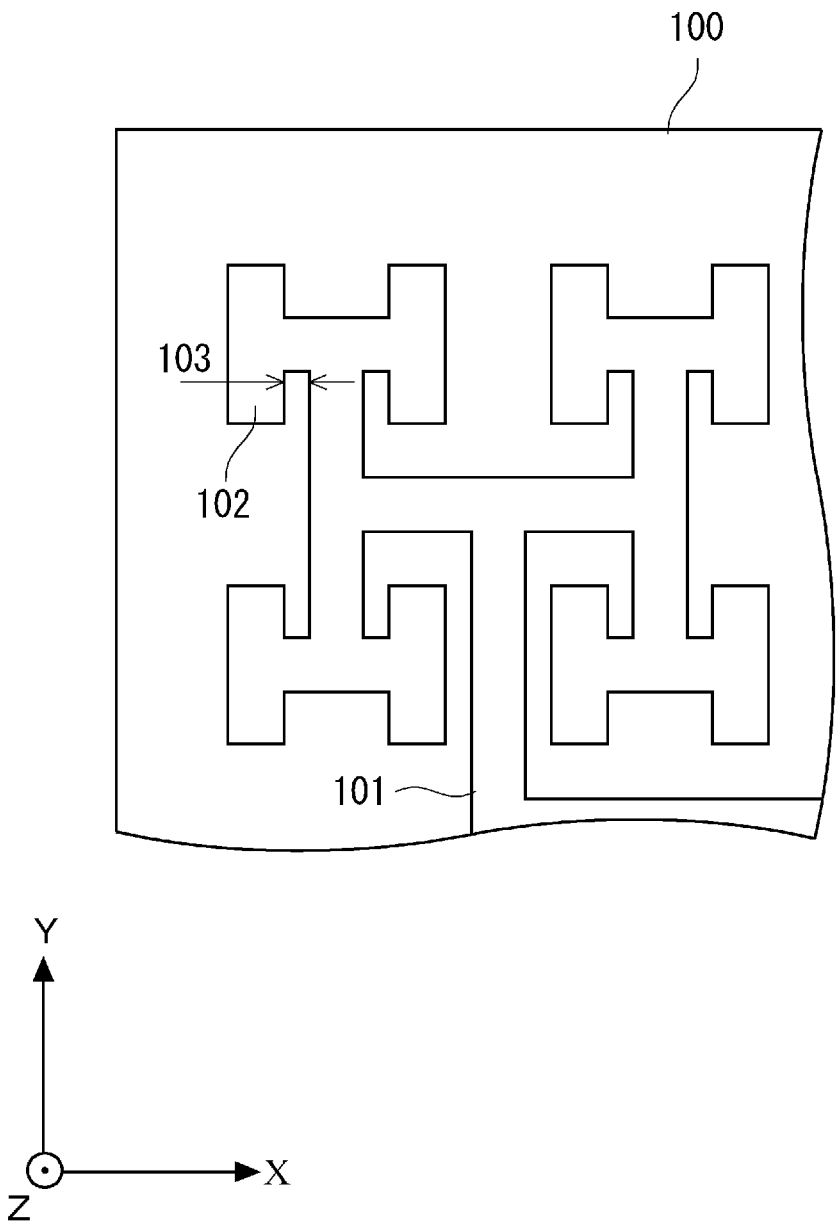
FIG. 11 shows an example of a feeder circuit having a tournament structure in related art.
Figure 12:
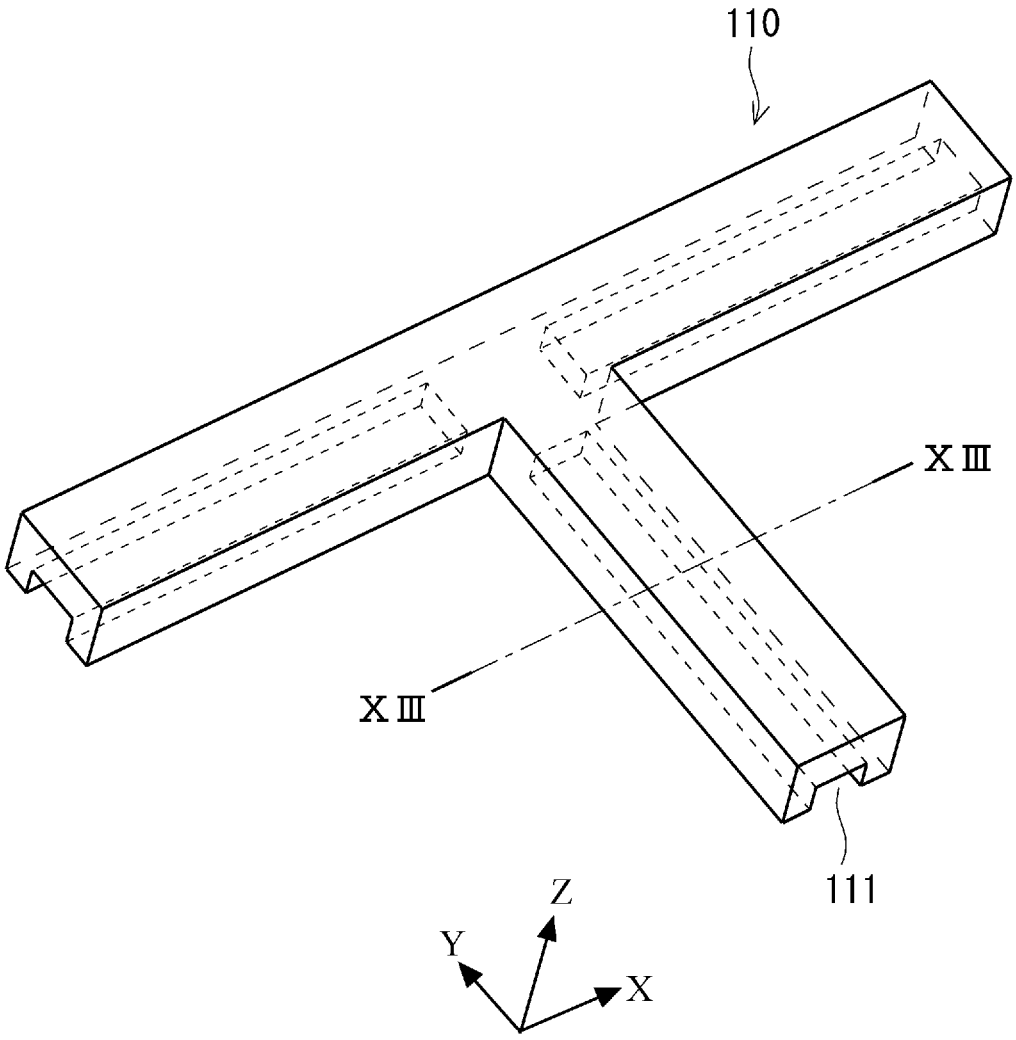
FIG. 12 shows a T-branch circuit of a normal ridge waveguide.

The S-shaped ridge waveguide shown in FIG. 10A does not include the step structures 43 and 44. That is, the S-shaped ridge waveguide shown in FIG. 10A has a structure in which, in the tube-axial direction, there is only one step between the branch center of the T-branch circuit and the S-shaped structure.

In contrast to this, the S-shaped ridge waveguide 40 shown in FIG. 10B includes the step structures 43 and 44 in the tube-axial direction. In the examples shown in FIGS. 9 and 10B, the S-shaped ridge waveguide 40 includes two-step step structures 43 and 44 in the tube-axis direction. In this way, the S-shaped ridge waveguide 40 has a structure in which there are two steps between the branch center 45 of the T-branch circuit and the S-shaped structure 46. Therefore, in the S-shaped ridge waveguide 40, it is possible to smoothly convert an impedance between the branch center 45 and the S-shaped structure 46 as compared to the structure shown in FIG. 10A.

Note that in the examples shown in FIGS. 9 and 10B, each of the step structures 43 and 44 of the S-shaped ridge waveguide 40 is formed as a two-step step structure. However, the step structure is not limited to this structure and may be a step structure including three steps or more. That is, each of the step structures 43 and 44 may include n steps (n is an integer no less than two).

As described above, the S-shaped ridge waveguide 40 according to the third embodiment of the present invention includes the step structures 43 and 44 in the tube-axis direction. As a result, in the S-shaped ridge waveguide 40, it is possible to smoothly convert the impedance between the branch center 45 and the S-shaped structure 46.

Note that in the third embodiment, the S-shaped ridge waveguide 40 including the step structures 43 and 44 in the tube-axis direction is described. However, the structure of the S-shaped ridge waveguide is not limited to this structure. For example, the ridge waveguide 10 according to the first embodiment may have a structure including step structures 43 and 44 in the tube axis direction.

Although the present invention is explained above with reference to embodiments, the present invention is not limited to the above-described embodiments. Various modifications that can be understood by those skilled in the art can be made to the configuration and details of the present invention within the scope of the invention.

REFERENCE SIGNS LIST

10 RIDGE WAVEGUIDE
11 RIDGE PART
14 SIDE IN LONG-SIDE DIRECTION
15 SIDE IN SHORT-SIDE DIRECTION
20 S-SHAPED RIDGE WAVEGUIDE
21, 22 RIDGE PART
23, 25 SIDE IN LONG-SIDE DIRECTION
24, 26 SIDE IN SHORT-SIDE DIRECTION
40 S-SHAPED RIDGE WAVEGUIDE
41, 42 RIDGE PART
43, 44 STEP STRUCTURE

The invention claimed is:

1. A ridge waveguide comprising a ridge part, the ridge part being in contact with both a side in a long-side direction and a side in a short-side direction in a cross-sectional shape of the ridge waveguide, wherein, in a branch circuit, the ridge waveguide is branched off, the ridge waveguide comprises a step structure including n steps (n is an integer no less than two) in a tube-axis direction toward a center of the branch circuit, and a height of the steps decreases as a distance of the steps from the center of the branch circuit decreases in the tube-axis direction.

2. The ridge waveguide according to claim 1, comprising a plurality of ridge parts.

3. The ridge waveguide according to claim 2, wherein the cross-sectional shape of the ridge waveguide is an S-shape.

4. The ridge waveguide according to claim 1, wherein the ridge waveguide has a structure in which a thin-plate metal, a metal-plated printed circuit board, a metal-plated plastic, or a conductive resin material is laminated.

5. An array antenna apparatus comprising a feeder circuit formed by a ridge waveguide according to claim 1.

* * * * *